United States Patent [19]

Paoli

[11] 4,128,293

[45] Dec. 5, 1978

[54] CONDUCTIVE STRIP

[75] Inventor: Alfred Paoli, Chicago, Ill.

[73] Assignee: Akzona Incorporated, Asheville, N.C.

[21] Appl. No.: 847,992

[22] Filed: Nov. 2, 1977

[51] Int. Cl.[2] ..... H01R 13/12

[52] U.S. Cl. ..... 339/258 R; 339/95 R; 339/252 R

[58] Field of Search ..... 339/95 R, 252 R, 252 S, 339/255 RT, 256 R, 256 RT, 256 RS, 258

[56] References Cited

U.S. PATENT DOCUMENTS

| | | | |
|---|---|---|---|
| 3,453,587 | 7/1969 | Neidecker | 339/256 RT |
| 3,861,776 | 1/1975 | Deal | 339/256 R |
| 4,039,238 | 8/1977 | Johnson, Jr. et al. | 339/256 RT |
| 4,050,149 | 9/1977 | Storck et al. | 339/252 R |

FOREIGN PATENT DOCUMENTS

| | | | |
|---|---|---|---|
| 1465104 | 1/1969 | Fed. Rep. of Germany | 339/256 R |
| 2632851 | 4/1977 | Fed. Rep. of Germany | 339/256 R |
| 978227 | 12/1964 | United Kingdom | 339/256 S |
| 450271 | 12/1974 | U.S.S.R. | 339/256 R |

*Primary Examiner*—Joseph H. McGlynn
*Attorney, Agent, or Firm*—Francis W. Young; David M. Carter

[57] ABSTRACT

A conductive strip for providing electrical contact between a pin and a socket in an electrical connector. An elongated metallic band having a plurality of substantially parallel fingers is formed from the strip. One end of each finger is attached to and integral with the strip. The unattached ends of the fingers alternately project away from each large surface of the strip. The unattached ends of the fingers are oblique with respect to the longest side dimension of said strip. The oblique fingers provide a large surface area for contact, as well as a snow plow effect for providing the removal of oxides from the pin contact during insertion or retraction of the pin. A groove is provided between adjacent fingers for giving strength thereto.

9 Claims, 8 Drawing Figures

CONDUCTIVE STRIP

BACKGROUND OF THE INVENTION

This invention relates to electrical connectors. More particularly, it relates to an improved conductive strip for providing electrical contact between a pin and a socket in an electrical connector.

In the field of high current electrical connectors it is necessary to have good electrical contact between the pin and socket of the mating connectors. If good electrical contact is not provided, a high resistance may be created causing excess heat buildup within the connector resulting in connector failures. Also, insufficient current may be provided to a device which is under electrical load. In order to provide positive connection between the pin and socket in a high current connector, cylindrical conductive bands have been provided either attached to the pin or seated within the socket of the connector. Examples of such conductive bands are disclosed in U.S. Pat. No. 2,217,433, assigned to Westinghouse Electric Manufacturing Company, U.S. Pat. No. 3,181,044, assigned to the United States of America and U.S. Pat. No. 3,453,587, assigned to Multi-Contact A.G. All of the above patents disclose a cylindrical band having a plurality of slits therethrough. Between adjacent slits a pair of fingers are formed; one finger of each pin projecting away from the upper surface of the band and the other finger projecting away from the lower surface of the band. One set of fingers contact the pin and the other set of fingers contact the socket. The adjacent fingers then would serve as a spring mechanism to help provide a positive electrical contact between the pin and the socket. One of the problems with these prior art contact bands is that there was the lack of surface area at the finger edges for contacting the pin and socket. Furthermore, since the fingers are at right angles to the longest side dimension of the band, the pin motion was exactly parallel to the finger edges. Therefore, there was very little wiper action by the finger edges to remove oxides and other foreign matter off the surface of the pin to give a good electrical connection. Further, the finger sets in the bands have little strength, thus fingers collapse after a given number of insertions and retractions of the pin, further limiting electrical contact.

OBJECTS OF THE INVENTION

It is one object of this invention to provide an improved conductive strip as a spring contact between a pin and a socket and an electrical connector.

It is another object of this invention to provide an improved conductive strip for cleaning the surface of either a pin or a socket by using a snowplow wiper effect.

It is a further object of this invention to provide a conductive strip having more surface area of contact than prior art strips.

It is another object of this invention to provide an improved conductive strip having fingers which have been strengthened for permitting multiple insertions and retractions of a pin contact without substantial damage to the band.

SUMMARY OF THE INVENTION

In accordance with one form of this invention, there is provided a conductive strip for providing electrical contact between a pin and a socket in an electrical connector. The strip includes an elongated metalic member adapted to be formed into the shape of a cylindrical band. The strip has a plurality of substantially parallel fingers, one side of which is integral with and attached to the strip while the other side projects away from at least one surface of the strip. The non-integral sides of the fingers are oblique with respect to the longest side dimension of the strip for providing a snowplow effect for removing oxides and other foreign material from the contact as well as providing sufficient surface area of contact between the socket and the pin. An embossed strength member is provided between adjacent fingers for providing strength to the fingers thus permitting multiple insertions and retractions of the pin to and from the socket.

DESCRIPTION OF THE PREFERRED EMBODIMENT

Figure 1:
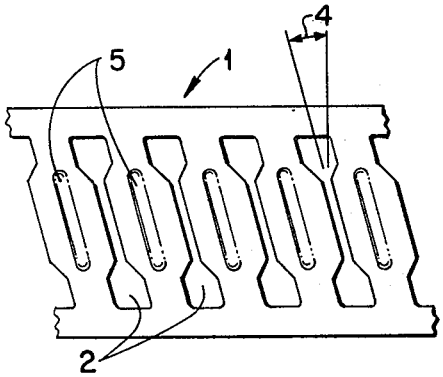
FIG. 1 is a partial side elevational view of a conductive strip incorporating some of the features of this invention.
Figure 2:
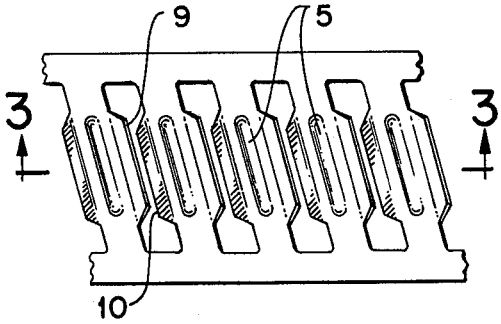
FIG. 2 is a partial end elevational view of the device of FIG. 1 with the fingers formed.
Figure 3:
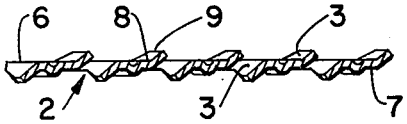
FIG. 3 is a sectional edge view of the strip shown in FIG. 2 taken above line A—A.

Referring now more particularly to FIG. 1, there is provided conductive strip 1 having a plurality of slots 2 punched therethrough. The band is made of an electrically conductive metal, such as copper alloy strip, which is also easily formed and stamped. The punchings 2 are made in an hourglass shape so that the long sides may be readily formed into fingers 3 as shown in FIG. 3. FIGS. 2 and 3 show a portion of strip 1 with the plurality of fingers 3–9, some of which are bent away from the upper surface of the strip while others are bent away from the lower surface. The edges of the fingers are indicated as 9 and 10, respectively. The punchings, and thus the fingers, are formed at an oblique angle with respect to the longitudinal axis of the strip indicated as 4. Thus the punchings and the resulting fingers 3 are not perpendicular to the longest dimension of the conductive strip as was done in the prior art. These oblique fingers provide at least two advantages over the prior art. First of all, the angled finger provides a snow plow wiper effect when the pin is inserted into and retracted from the socket in that oxides and other foreign matter are removed from the pin enabling better electrical contact. Secondly, since the fingers are at a non-perpendicular angle with respect to the longitudinal axis of the strip, a longer punching tool may be employed and thus a longer finger than the prior art will result. This enable more surface contact between the strip and the pin and/or socket. This will be seen in better detail below.

In the embodiment of FIG. 1, the angle 4 is shown, for illustration purposes, to be rather large. However, this angle may be any angle greater than 0 but less than 90°. In an embodiment which has been tested, the angle 4 was approximately 3°.

FIG. 3 shows an edge sectional view of the strip shown in FIG. 1 with the fingers 3 alternately projecting away from the upper surface 6 and the lower surface 7 of the strip. One end 8 of each finger is attached to and integral with the surface while the other end is edge 9 which is the free end and which provides the electrical contact either with the socket or the pin.

Figure 4:
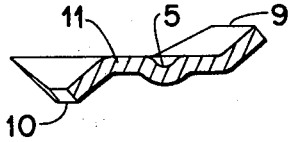
FIG. 4 is a fragmentary end view of a portion of the device shown in FIG. 3 with the end portion to the right of line B—B removed.

FIG. 4 shows the portion to the right of B—B of the edge view of FIG. 2. Embossment 5, which is in the form of a groove, provides for additional strength between adjacent fingers so that when there is pressure on finger edges 9 and 10, the fingers and the portion of strip between the fingers do not readily become distorted. Such distortion has, in the past, been a source of poor electrical contact.

Figure 5:
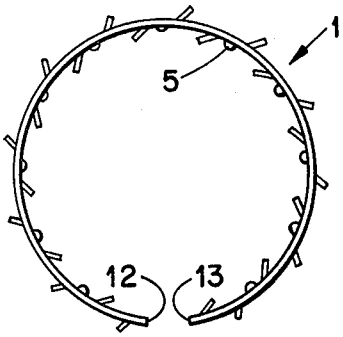
FIG. 5 is an end elevational view of the strip of FIG. 2 having been formed into the shape of a band.
Figure 6:
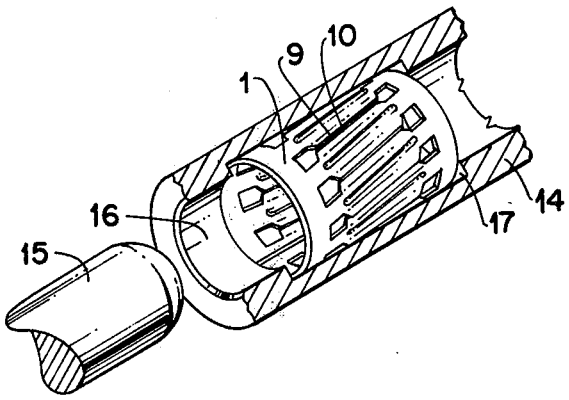
FIG. 6 is a partial sectional isometric view of the band of FIG. 5 in the environment in a connector socket together with a pin to be inserted in the socket.

Referring now to FIG. 5, the conductive strip is formed into the shape of a cylindrical band for insertion into an electrical socket or around a pin contact. If the cylindrical band is to be inserted into a socket such as shown in FIG. 6, normally the ends 12 and 13 are left free so as to provide spring force against the side walls of the socket. However, if the band is to be fitted around the outside surface of the pin contact, then normally the ends 12 and 13 are welded together.

FIG. 6 shows a socket contact 14 and a pin contact 15. Socket contact 14 includes hollow cylindrical portion 16 adapted to receive the pin contact 15. An annular recessed portion 17 is provided, in this embodiment, to receive annular band 1. As can be seen, finger edges 10 project away from the upper surface of the band to provide electrical contact between the band and the cylindrical wall of the socket contact. Finger edges 9 project extending from the inner surface of the band to provide electrical contact between the band and the pin contact 15 upon insertion of the pin into the socket. Since these fingers are oblique with respect to the longest side dimension of the band, a scrapping snow plow effect occurs between the finger edge 7 and the pin contact 15. Thus, oxides and other foreign materials are removed from the pin contact each time the contact is inserted and/or retracted from the socket. The pin may be completely cleaned of foreign material after a number of insertions and retractions. Also,a large surface area of contact is made between the band and the pin and between the band and the socket since these fingers are at an angle. The contact between these finger edges and the socket and pin may be better seen in reference to FIGS. 7 and 8.

Figure 7:
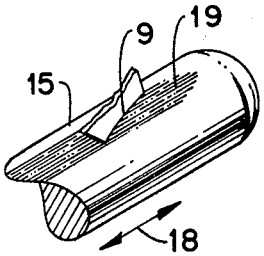
FIG. 7 is a partial elevational view of a pin showing a portion of one of the fingers of the band in contact with the pin.

FIG. 7 shows a portion of pin 15 and a broken-away portion of finger 3 having its edge 9 contact with the pin. As can be seen by the angle of contact with respect to the pin, upon movement of the socket in either direction indicated by the arrows 18, the surface of the shaded portion 19 will be wiped by the edge 9, thus removing the oxides and other foreign materials from the pin contact.

Figure 8:
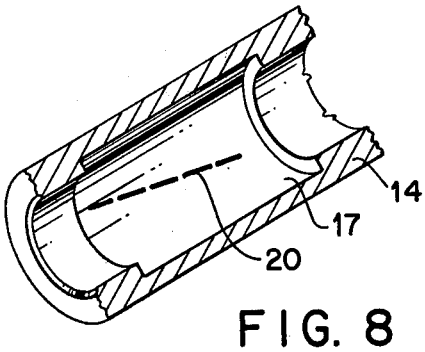
FIG. 8 is a partial cross-sectional view of a socket showing how one of the fingers of the band engage the inner surface of the socket.

Referring now to FIG. 8, the annular recessed band receiving chamber 17 is shown. The dotted line indicates the area of contact between band finger edge 10 and the inner surface of chamber 17. Since these two finger edges 9 and 10 are at oblique angles, the contact with the pin and socket is greater than it was in the past where the finger edges were perpendicular to the longest dimensional side of the band. Furthermore, with the addition of the U-shaped strength member 5, the possibility of the fingers 3 buckling under the stress caused by the insertion and retraction of the pin contact is greatly reduced.

As stated previously, it is also possible to place the band about the pin contact rather than the socket by welding the ends 12 and 13 of the band together. Thus, the snow plow or wiper effect would apply to the inner cylindrical surface of the socket contact in that case.

From the foregoing description of the embodiment of the invention, it is apparent that many modifications may be made therein. It is intended in the appended claims, therefore, to cover such modifications within the true spirit and scope of the invention.

What I claim is:

1. A conductive strip for providing electrical contact between a pin and socket in an electrical connector comprising: an elongated metallic strip, said strip having a plurality of substantially elongated parallel fingers projecting away from at least one surface of said strip; said fingers having two sides; one side of said fingers being attached to and integral with said strip; the unattached side of said fingers forming an edge adapted to contact a pin or a socket; the longest dimension of said edge of said fingers being at an oblique angle with respect to the longest dimensional side of said strip.

2. A conductive strip as set forth in claim 1, wherein said fingers project alternately from both surfaces of said strip.

3. A strip as set forth in claim 1, wherein said angle is approximately 3°.

4. A conductive strip as set forth in claim 1, wherein said fingers are formed in pairs; a slit is provided between adjacent pairs of fingers on said strip.

5. A conductive strip as set forth in claim 4, further including a groove between each finger in a pair for providing resilient strength to each of said finger pairs.

6. A strip as set forth in claim 1, wherein said strip is formed in the shape of a cylindrical band adapted to be placed between the pin and socket contacts.

7. A strip as set forth in claim 6, wherein said band is adapted to be placed in an annular grooved section of a socket contact.

8. A strip as set forth in claim 7, wherein said band has a pair of free ends for providing spring force on the sides of the annular grooved out portion of the socket.

9. A conductive strip for providing electrical contact between a pin and a socket of an electrical connector comprising: a metallic strip formed in the shape of a band, said strip having a plurality of pairs of elongated parallel fingers; said fingers having first and second sides; said first side being attached to and integral with said strip; said second side of said fingers being a free end and forming an edge away from a surface of said strip; said edge adapted to contact the pin or the socket; the longest dimension of said edge of said fingers being oblique to the longest side dimension of said strip; the fingers projecting from opposite sides of said strip; at least one groove embossment between adjacent fingers in each pair on said strip.

* * * * *